US005243826A

United States Patent [19]

Longsworth

[11] Patent Number: 5,243,826

[45] Date of Patent: Sep. 14, 1993

[54] METHOD AND APPARATUS FOR COLLECTING LIQUID CRYOGEN

[75] Inventor: Ralph C. Longsworth, Allentown, Pa.

[73] Assignee: APD Cryogenics Inc., Allentown, Pa.

[21] Appl. No.: 907,374

[22] Filed: Jul. 1, 1992

[51] Int. Cl.[5] ..... F25B 19/02

[52] U.S. Cl. ..... 62/51.2; 62/51.1; 62/50.7

[58] Field of Search ..... 62/6, 51.1, 51.2, 50.7; 165/10, 155

[56] References Cited

U.S. PATENT DOCUMENTS

| | | | |
|---|---|---|---|
| 3,257,823 | 6/1966 | Hogan | 62/51.2 X |
| 3,422,632 | 1/1969 | Currie et al. | 62/51.2 |
| 3,704,597 | 12/1972 | Nicholds | 62/51.2 X |
| 3,942,010 | 3/1976 | Peterson et al. | 62/51.2 X |
| 4,152,903 | 5/1979 | Longsworth | 62/51.2 X |
| 4,177,650 | 12/1979 | Campbell | 62/51.2 X |
| 4,381,652 | 5/1983 | Kunimoto | 62/51.2 X |
| 4,781,033 | 11/1988 | Steyert et al. | 165/10 X |
| 5,012,650 | 5/1991 | Longsworth | 62/51.2 |

FOREIGN PATENT DOCUMENTS

| | | | |
|---|---|---|---|
| 1358668 | 3/1964 | France | 62/51.1 |

*Primary Examiner*—Henry A. Bennet
*Assistant Examiner*—Christopher B. Kilner
*Attorney, Agent, or Firm*—Helfgott & Karas

[57] ABSTRACT

A method and apparatus for cooling and filling a cryogen reservoir with liquid cryogen from the gas/liquid discharge of a heat exchanger. The cryogen reservoir has a cryogen liquid retaining material and a temperature sensing means remote from the heat exchanger. The gas/liquid discharge is located in a region within the reservoir proximate to the temperature sensing means. At least a portion of the discharge is passed through the liquid retaining material to be absorbed, thereby.

19 Claims, 2 Drawing Sheets

METHOD AND APPARATUS FOR COLLECTING LIQUID CRYOGEN

FIELD OF THE INVENTION

This invention relates to the field of cryostats, and more particularly to methods and apparatus for collecting liquid cryogen derived from the gas/liquid discharge of the cryostat heat exchanger. This collected liquid cryogen can subsequently be exposed to a vacuum or reduced pressure after the fluid flow through the heat exchanger is stopped to maintain a cryogen temperature in the cryostat by evaporation or sublimation of the liquid.

BACKGROUND OF THE INVENTION

Such cryostats are used, for example in infrared (IR) detectors and missile guidance systems which operate under cryogenic conditions. For many such applications, particularly for space-related applications, the vacuum of space may be utilized to reduce the vapor pressure over the cryogen below its normal boiling temperature, even to the point where the cryogen will freeze and cool the IR detector below the triple point of the cryogen, e.g., 63° K. for $N_2$ and 14° K. for $H_2$. For this purpose, it is necessary to collect the liquid cryogen in a matrix that will retain the cryogen while the pressure is reduced. Heat is transferred from the detector to the liquid or solid cryogen as it evaporates or sublimes. The matrix must be effective not only to collect and retain the liquid cryogen, but also to transfer heat from the detector to the cryogen in the matrix.

One matrix for collecting and retaining liquid and solid cryogen is described and claimed in my U.S. Pat. No. 5,012,650. This matrix comprises multiple layers of at least one highly adsorbent material and at least one relatively porous high thermal conductivity material. The highly adsorbent material, which may be described as a "wick" material, may comprise various materials with fine pores or fibers, including particularly glass fiber paper as well as polyester cotton. The porous high thermal conductivity material may conveniently comprise a wire mesh screen of 100 to 150 mesh for a small matrix, i.e. one centimeter thick, while a coarser wire screen is suitable for a larger matrix. Copper or aluminum, which have high thermal conductivity at cryogenic temperatures make good screen materials. The matrix may be formed as stacked alternate layers of wire mesh and glass fibers, or as a wound roll of wire mesh and glass fiber. Further details of the composition and construction of this storage matrix is described in this U.S. Pat. No. 5,012,650.

In one embodiment of a cryostat described in this U.S. Pat. No. 5,012,650, the storage matrix is contained in a reservoir directly connected to a Joule-Thompson (JT) heat exchanger. The gas/liquid mixture discharge from the restricted orifice of the JT heat exchanger is directed to inpinge against and flow over the top surface of the matrix material to cool the matrix and fill the reservoir with liquid cryogen. However, it has been found in practice that although liquid is generated at the orifice shortly after gas flow is initiated, the matrix is cooled and the reservoir is filled relatively slowly.

In a second embodiment also described in this U.S. Pat. No. 5,012,650, the storage matrix is contained in a separate reservoir which is connected to receive a separate source of cryogen gas. This reservoir is externally cooled by the heat exchanger. With this arrangement the matrix can be cooled and the reservoir filled more rapidly, but the cryostat assembly is considerably heavier, more complicated and more expensive.

SUMMARY OF THE INVENTION

Accordingly it is an important object of the invention to provide a new method and cryostat apparatus for rapidly generating and retaining liquid cryogen in a reservoir connected to receive the gas/liquid discharge of a cryogen heat exchanger such as a Joule-Thompson heat exchanger.

However, in some cryostat applications there is a need not only to provide such rapid retention of liquid cryogen within the reservoir attached to the heat exchanger, but also simultaneously rapidly to cool a temperature sensor, such as an IR detector, which is in direct heat conducting relation to a wall, usually the bottom wall, of the reservoir. This is quite difficult to do because the optimum rate of fluid flow in the reservoir for rapid liquid retention is less than that desired for rapid cooling of the temperature sensor. This difficulty is further aggravated by the need to also provide excellent heat conduction between the liquid retained in the storage matrix and this same temperature sensor after the fluid flow from the heat exchanger has been stopped, and the liquid within the reservoir is vented to a reduced pressure in order to cool the cryostat down to lower temperatures.

Therefore, further objects of the invention are to provide a new method for rapidly retaining liquid cryogen in a reservoir connected to receive the fluid discharge of a cryogen heat exchanger and for simultaneously rapidly cooling a temperature sensor that is in heat conducting relation with a wall of the reservoir, as well as to provide a new cryostat assembly for accomplishing such simultaneous cryogen liquid retention and temperature sensor cooling which also provides excellent heat conduction between the retained cryogen and the temperature sensor when the retained cryogen is subsequently subjected to reduced pressure.

Still further objects of the invention are to provide new methods and apparatus for increasing the rate of liquid generation derived within a reservoir from the gas/liquid discharge of a Joule-Thompson heat exchanger and for controlling the rate of liquid retention relative to the rate of cooling within the reservoir. An ancillary object is to be able to control the split between the liquid and gas which flow through the reservoir.

In general, in accord with the new methods of my invention, I have found that the rate and amount of liquid cryogen retained in a storage matrix derived from the gas/liquid discharge of a heat exchanger may be enhanced by forcing at least a portion of the discharge to pass through the matrix rather than only against and across a surface of the matrix. I have also found that the rate of liquid retention in the matrix may also be further enhanced by causing a portion of the discharge to bypass the matrix and return directly to the heat exchanger.

In addition, I have found that it is possible to enhance the rate of cooling of a temperature sensing means located in heat conducting relation to a wall of the reservoir by directing at least a portion of the gas/liquid discharge of the heat exchanger into proximity with this reservoir wall. This rate of cooling may also to some extent be regulated and optimized by controlling the fraction of the discharge which is forced through the storage matrix relative to the fraction which by-passes the matrix and is returned directly to the heat exchanger. The fluid flow that by-passes the storage matrix is at a relatively high velocity and thus enhances the cooling effect while the fraction of the fluid flow that passes through the storage matrix is at a lower velocity which fortuitously also enhances the liquid retention.

Cryostats embodying the invention in general comprise a reservoir connected to receive the gas/liquid discharge of a Joule-Thompson heat exchanger and a storage matrix within the reservoir containing a highly adsorbent wick material. The outlet tube of the heat exchanger is extended within the reservoir to a position where its restricted orifice may direct at least a portion of the discharge to pass through the wick material of the matrix before returning to the heat exchanger. In accord with one feature of the invention, the wick material of the matrix is located in spaced relation to at least a portion of a wall of the reservoir which comprises a temperature sensing means, and at least a portion of the gas/liquid discharge from the orifice of the heat exchanger is directed to flow in proximity with this wall within the space thus provided. In accord with a further feature of the invention, means are also provided enabling a portion of the discharge to flow directly back to the heat exchanger and thus to by-pass the storage matrix in the reservoir.

In one embodiment of the invention, this matrix flow by-passing means comprises a baffle plate which may completely or partially obstruct a return flow passageway, which may conveniently be a central core passageway defined by a cylindrical storage matrix. In a second embodiment of the invention, this matrix flow by-passing means comprises a gas/liquid separation means, preferably of the vortex phase separator type located in the return flow passageway and operating in conjunction with a vortex fluid discharge from the orifice of the heat exchanger. This separation means increases the amount of liquid generated and transferred to the storage matrix relative to the amount of gas which is by-passed back to the heat exchanger. An adjustable valve means associated with this gas/liquid separation means permits adjustment of the fraction of the fluid discharge which passes through the storage matrix relative to the fraction which by-passes the matrix.

BRIEF DESCRIPTION OF THE DRAWINGS

The novel features believed characteristic of the invention are set forth in the appended claims. The invention itself, together with any further objects and advantages thereof, can best be understood by referring to the following description taken in conjunction with the accompanying drawing wherein.

DETAILED DESCRIPTION OF THE INVENTION

Figure 1A:
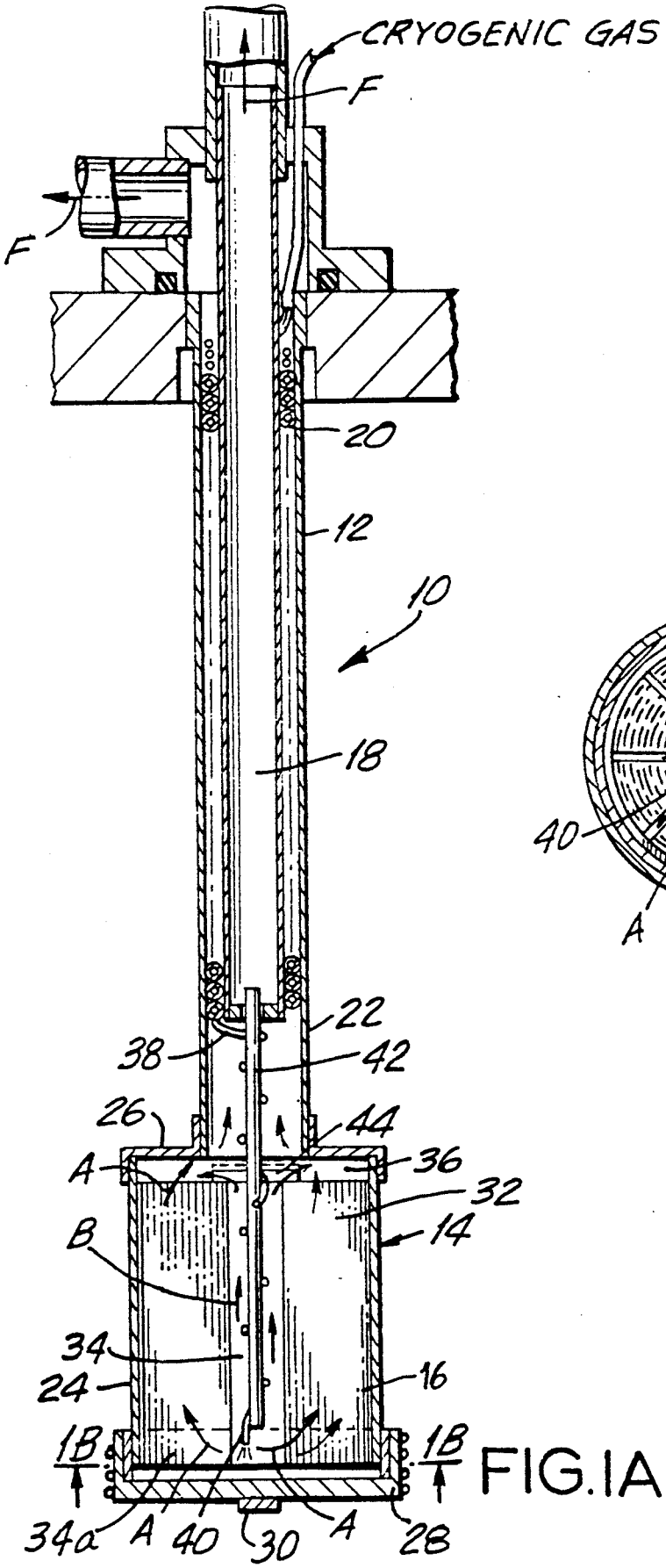
FIG. 1A is a cross-sectional view of a cryostat assembly comprising a Joule-Thompson heat exchanger and a cryogen storage reservoir illustrative of the invention.

Referring to FIG. 1, there is shown a cryostat assembly 10 including a heat exchanger 12 and a reservoir 14 containing storage matrix 16. Heat exchanger 12 is shown as a Joule-Thompson finned tube type with a central mandrel 18 around which the gas-containing tubing 20 is wound. An outer cylindrical casing 22 surround the tubing 20 and extends below the bottom end of mandrel 18 to support the reservoir 14. Reservoir 14 has a cup-shaped outer housing 24 which is attached to the bottom end of casing 22 by an annular cover 26. A temperature sensing means including a highly heat conductive bottom plate 28 and a central temperature sensing element 30 is attached in direct heat conducting relation to the bottom of reservoir housing 24. Temperature sensing element 30 may, for example, constitute an IR sensor.

Storage matrix 16 comprises alternate cylindrical layers of high thermal conductivity porous material, such as copper wire mesh, and highly adsorbent wick material, such as glass fiber paper. These alternate cylindrical layers are stacked or rolled together to form a tightly packed thick annular cylinder 32 which extends radially to the outer cylindrical side wall of the reservoir housing 24.

Figure 1B:
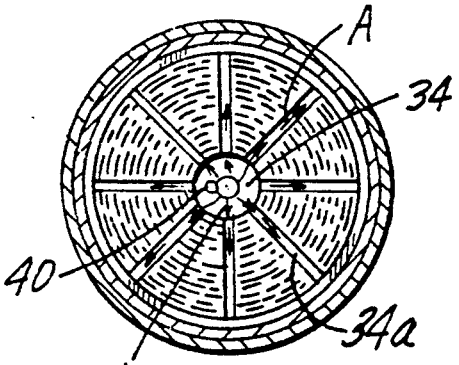
FIG. 1B is a sectional view of the storage reservoir of FIG. 1A taken along the bottom internal wall of the reservoir.

In accord with the invention, the central axial core region of the reservoir is kept free of matrix material so that the matrix defines a central cylindrical fluid passageway 34. As best seen in FIG. 1B, the lower end region of the annular storage matrix 16 immediately adjacent the bottom wall is preferably cut away to form a plurality of radial fluid passageways 34*a* beneath the bulk of the matrix 16 which communicate with the central cylindrical passageway 34. The height of the matrix is also made less than the height of the reservoir such that a space 36 for fluid passage also remains between the top surface of the matrix and the cover 26 of the reservoir. This space 36 communicates with the interior of casing 22 to provide a return flow path back to the heat exchanger.

In order to practice the new method of the invention, the restricted outlet tube portion 38 of the J-T heat exchanger is elongated and extends down within the axial passageway 34 so that its restricted discharge orifice 40 is located adjacent to the temperature sensing means at the bottom of the reservoir. This elongated outlet tube portion 38 may be supported by being wound around a rod 42 which is suspended at its upper end from the bottom of mandrel 18. The gas/liquid discharge from the orifice 40 is thus located in a region of the reservoir that is proximate both to a portion of the temperature sensing wall of the reservoir and a portion of the cryogen storage matrix that is remote from the heat exchanger. Because of this location, the discharge will be effective to cool the temperature sensing element 30, and at least a portion of the discharge will pass through the radial passageways 34*a* and up through the storage matrix, as indicated by arrows A, before it returns to the heat exchanger. As the gas/liquid discharge flows through the matrix, it passes over, and through the pores of, the adsorbent wick material, and the liquid in the discharge is retained thereby.

The rate of flow through the matrix, and the speed and amount of liquid retention within the reservoir may be adjusted by controlling the percentage of fluid flow which passes through the matrix relative to the percentage which by-passes the matrix before it returns to the heat exchanger. In the embodiment of FIG. 1 this is accomplished by a circular baffle plate 44 which overlies and spans the central passageway 34. Plate 44 is preferably connected to rod 42 and may be adjusted either to rest against the upper surface of the annular matrix 32 or to extend slightly above this upper surface. When plate 44 rests against matrix 32, it completely blocks passageway 34, and all of the discharge from orifice 40 is forced to flow through the matrix 32. As plate 44 is elevated to positions away from the top of matrix 32 toward the heat exchanger, the passageway becomes successively more unblocked and permits an increasing percentage of the fluid discharged from orifice 40 to flow from passageway 34, as indicated by arrows B, directly into the space 36 above the matrix 32 and thereby by-pass the corresponding percentage of flow through the matrix. It has been found in practice that by-passing some of the flow through the matrix helps reduce the velocity of the flow through the matrix and improves liquid retention. It also permits a relatively high velocity of discharge to be maintained in the region of the temperature sensing assembly so that the temperature sensor can be cooled more rapidly by the fraction of the flow that is returned directly to the heat exchanger from passageway 34 without passing through the matrix. It will be appreciated that the optimum percentage of fluid flow that is adjusted to by-pass the flow through the matrix will depend upon several factors including the nature and pressure of the cryogen gas introduced into the heat exchanger and the impedance to fluid flow provided by the matrix.

Figure 2A:
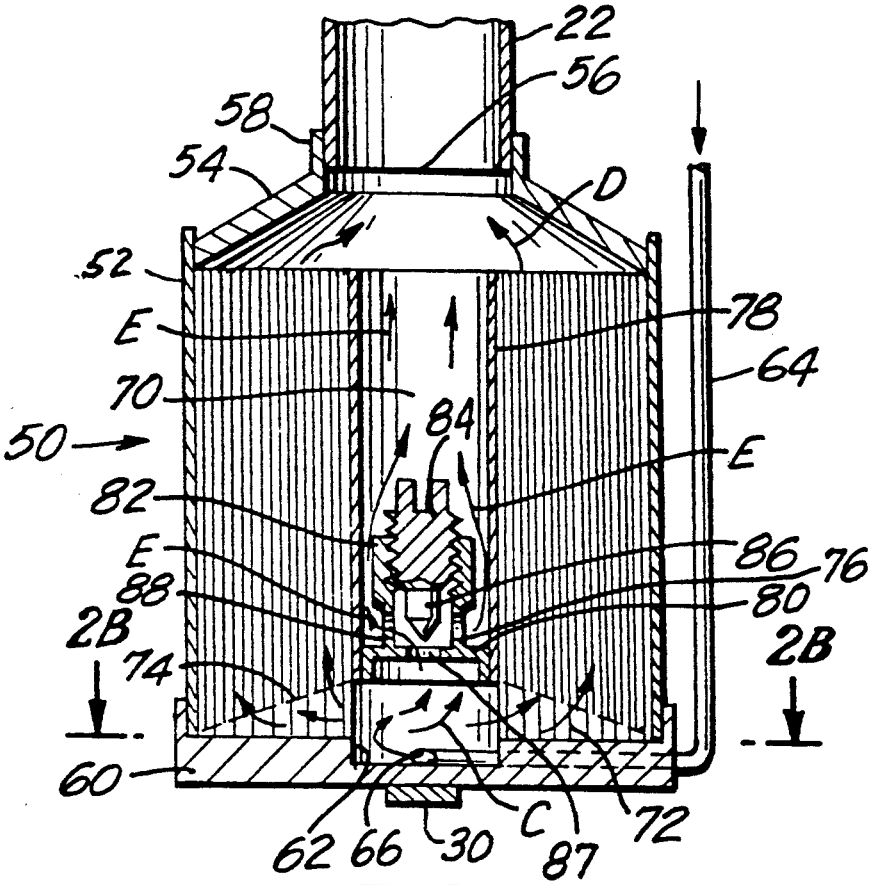
FIGS. 2A and 2B are transverse cross-sectional views of an alternative cryogen storage reservoir illustrative of certain additional features of the invention.
Figure 2B:
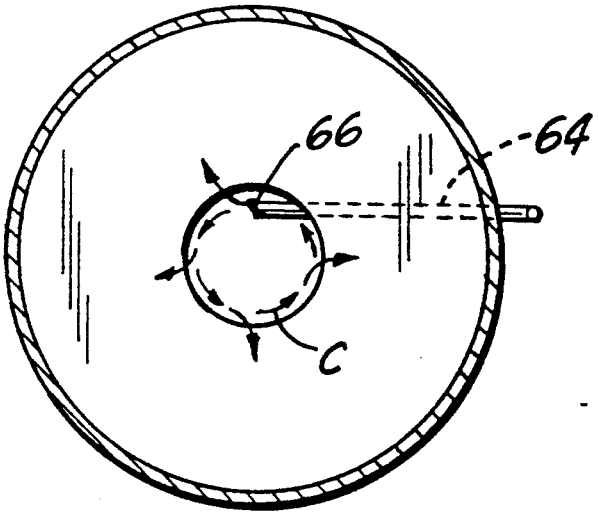

Referring now to FIGS. 2A and 2B, there is shown an alternative reservoir which illustrates certain additional features and advantages of the invention. In this reservoir, the rate of liquid retention is further enhanced by separating the gas and liquid in the discharge and directing the separated liquid to flow through the matrix while directing the separated gas to by-pass the matrix. In addition, in this reservoir, the rate of cooling is enhanced by locating the wick material in spaced relation to the bottom temperature sensing wall of the reservoir.

Specifically, a reservoir 50 is shown having a cylindrical side wall 52 to which is attached a frustro-conical annular cover 54 with a central opening 56 surrounded by collar 58. The outer casing 22 of the J-T heat exchanger is attached to this collar and provides the fluid return path to the heat exchanger. The bottom wall of the reservoir is a relatively thick heat conducting disk 60 which has a central circular depression 62 and is attached to the cylindrical side wall 52 of the reservoir.

The outlet portion 64 of the gas tube of the heat exchanger 12 is elongated and extended through casing 22 and alongside the side of reservoir 50, and then bent to pass through a bore in the bottom disk 60 which is offset and parallel to a radius of the disk so that the discharge orifice 66 of the tube 64 is located adjacent to and within the circumference of the central depression 62, as best seen in FIG. 2B. The tangential fluid discharge from orifice 66 at this circumferential location within the circular depression 62 produces a swirling vortex motion of the discharge adjacent the central region of the bottom disk 60, as indicated by the arrows C in FIG. 2B.

The storage matrix 68 is located in the annular cylindrical space between a central axial passageway 70 and the side wall 52 of the reservoir 50. However, in this reservoir 50, the layers of wick material within the matrix do not extend down to the temperature sensing bottom disk 60 in the region adjacent to this swirling vortex discharge. Only the temperature conducting wire mesh 72 extends the full distance down to the bottom disk 60 in order to be able to transfer the cooling effect of the cryogen stored in the wick material to the temperature sensing disk 60 during the subsequent evaporation stage. As indicated by dashed line 74, the layers of wick material extend down to the bottom wall only in the outer region immediately adjacent to the side wall and become gradually shorter as they approach the central passageway 70, thereby to provide an annular conical area free of wick material adjacent the entire central region of the temperature sensing bottom disk 60. It will be appreciated that this wick-free area permits the fluid discharge from orifice 66 to directly impinge upon the bottom of the layers of wick material over a wide area to enhance liquid retention and simultaneously exposes the entire upper surface of disk 60 to this discharge to enhance its cooling. The heat conducting wire mesh 72 is porous enough that it does not significantly impede the effect of this fluid discharge. The space 74 above the storage matrix communicates with the interior of the heat exchanger casing 22 and constitutes the return path for fluid passing through the matrix, as indicated by arrows D.

In accord with an additional feature of the invention, a means is provided for separating the liquid from the gas in the discharge before it passes through the matrix. This liquid-gas separation means comprises a vortex phase separator 76 located within axial passageway 70 above the vortex fluid discharge from orifice 66. The phase separator 76 is mounted at the bottom of a tube 78 within passageway 70 that is coextensive with the innermost cylindrical layer of wick material. The phase separator itself comprises a flow restricting plate 80 which extends across the passageway and contains a central hole 81 which communicates with the interior of a cylindrical valve body 82 of the separator. Plate 80 cooperates with the vortex fluid discharge to convert and separate a significant portion of liquid from the gas in the discharge. The external diameter of the valve body is less than the interior diameter of tube 78 so that space is provided for the passage of gas therebetween. A plug 84 is threaded into the interior of valve body 82 and has a lower end portion 86 which is tapered to fit within and gradually shut off the flow through hole 81 as the plug 84 is rotated. Additional holes 88 are formed in the lower wall of valve body 82 to permit passage of gas around the side of valve body 82 when plug 84 does not obstruct the gas flow through hole 81. Vortex phase separator 76 thus constitutes a means for separating the liquid from the gas in the fluid discharge from orifice 66 and also constitutes a valve means for controlling the fluid flow that by-passes the fluid flow through the storage matrix. It will be appreciated that the greater the percentage of the flow which by-passes the matrix, the lower the percentage, pressure and velocity of the flow which passes through the matrix.

In carrying out the new method of the invention, valve plug 84 is adjusted to provide the desired restriction of the flow through hold 81, and a cryogen gas is supplied under suitable pressure to outlet tube portion 64 from the J-T heat exchanger 12. This creates a vortex gas/liquid flow in the central region of the reservoir below the phase separator which results in a separation of liquid from the gas, the separated liquid remaining predominantly below plate 81 and being forced through the wick material of the matrix at a reduced velocity and the separated gas being passed through hole 81 in plate 80 and holes 88 in the valve body 82, as indicated by arrows E, to by-pass the matrix at a higher velocity.

Meanwhile, the temperature sensing disk 60 is being cooled by fluid discharge across its surface. This process is continued until the wick material within the matrix is sufficiently saturated and the gas flow through the heat exchanger is shut off. The reservoir may then be vented through the heat exchanger to a vacuum or other reduced pressure source, as indicated by the arrows F in FIG. 1, in order to cool the temperature sensing disk 60 to lower temperatures, as may be desired.

The preferred setting of the valve plug 84 will, of course, depend upon the nature and pressure of the cryogen gas being used as well as the dimensions and construction of the matrix. It has been found in practice that settings which establish flow velocities through the matrix of less than one m/s maximize retention of the cryogen liquid. For example, with a tightly rolled 1.9 cm diameter by 2.6 cm long cylindrical matrix of alternate layers of glass fibers and 60 mesh copper wire, and with nitrogen gas supplied to the JT heat exchanger at a pressure of 25 MP, and with valve plug 84 adjusted to by-pass about 50% percent of the fluid discharge from orifice 66; the temperature at detector 30 was cooled to 79 degrees K while the liquid nitrogen was being retained within the matrix at a rate of about 0.04 g per second. Temperatures well below the freezing temperature of nitrogen, 63 degrees K., were then achieved during the subsequent evaporation of the stored liquid nitrogen. While the methods and apparatus of the invention have been described in connection with specific embodiments, it is to be understood that the invention is not limited thereto and can be practiced within the scope of the appended claims.

What is claimed is:

1. A method of cooling and filling a cryogen reservoir connected to a heat exchanger with liquid cryogen from the gas/liquid discharge of the heat exchanger wherein said cryogen reservoir has a cryogen liquid retaining adsorbent material therein and a temperature sensing means to be cooled adjacent said adsorbent material and remote from said heat exchanger, said method comprising the steps of locating said gas/liquid discharge to first pass in a region within said reservoir proximate to and in heat conducting relation with said temperature sensing means and then passing at least a portion of said discharge over and through said liquid adsorbent material thereby to adjust both the rate of cooling of said temperature sensing means and the rate of liquid retention within said adsorbent material.

2. The method of claim 1 also comprising the steps of passing at least a portion of said gas/liquid discharge directly back to said heat exchanger so as to by-pass the portion passing through said adsorbent material, and controlling the fraction of the discharge which is by-passes directly back to said heat exchanger relative to the fraction which is passed through the adsorbent material thereby to increase both the rate of liquid retention and the rate of cooling of the temperature sensing means.

3. The method of claim 1 also comprising the steps of separating some of the liquid from the gas in the gas/liquid discharge in said region proximate to said temperature sensing means, and including said separated liquid in the portion of the discharge that is passed through said liquid adsorbent material.

4. The method of claim 3 also comprising the steps of including said separated gas in the portion of the discharge which is passed directly back to said heat exchanger, and controlling the rate of the discharge that is passed directly back to said heat exchanger to control the rate of liquid retention by said adsorbent material.

5. In combination, a heat exchanger having a restricted orifice for producing a cryogen gas/liquid discharge, a storage reservoir having a temperature sensing means to be cooled and being connected to receive the gas/liquid discharge from said orifice within said reservoir adjacent to and in heat conducting relation with said temperature sensing means, a cryogen liquid adsorbent material within said reservoir, and means for passing at least a portion of said discharge through said liquid adsorbent material to be adsorbed thereby said discharge passing means comprising a porous high thermal conductivity material in heat conducting relation with said temperature sensing means and said adsorbent material.

6. The combination of claim 5 wherein said reservoir has means for enabling a portion of said discharge to flow directly back to said heat exchanger and by-pass said portion of said discharge which passes through said adsorbent and has means for controlling the amount of said direct flow back portion of said discharge.

7. The combination of claim 5 wherein said reservoir has means for separating the liquid from the gas in said gas/liquid discharge and for including said separated liquid in the portion of said discharge which passes through said adsorbent material.

8. The combination of claim 6 wherein said reservoir also has means for including said separated gas in the portion of said discharge which passes directly back to said heat exchanger.

9. The combination of claim 5 wherein said gas/liquid discharge is arranged to produce a vortex fluid flow adjacent to said temperature sensing means, and the means for separating the liquid from the gas in said gas/liquid discharge is a vortex phase separator.

10. The combination of claim 5 wherein said reservoir has a bottom wall in heat conducting relations with said temperature sensing means, and said heat exchanger is a Joule-Thomson heat exchanger that is connected to the top of said reservoir and said gas/liquid discharge is located adjacent said bottom wall.

11. The combination of claim 10 wherein said liquid adsorbent material is contained within a storage matrix which comprises alternate layers of porous thermally conductive material and said liquid adsorbent material, said thermally conductive material extending in contact with said bottom wall and said liquid adsorbent material being spaced from said bottom wall so that said portion of said gas/liquid discharge flows through said pores of said thermally conductive material to cool said bottom wall before it passes through said liquid adsorbent material.

12. The combination of claim 10 wherein said liquid adsorbent material is contained within a storage matrix which defines a central passageway within said reservoir which comprises a return flow path to said heat exchanger, said gas/liquid discharge being located in said passageway adjacent said bottom wall.

13. The combination of claim 12 wherein means are provided within said reservoir for controlling the fraction of said gas/liquid discharge which passes through said matrix relative to the fraction which passes through said passageway back to said heat exchanger and by-passes said adsorbent material.

14. The combination of claim 13 wherein said discharge fraction controlling means comprises a baffle plate which overlies said passageway.

15. The combination of claim 13 wherein said discharge fraction controlling means comprises an adjustable valve means located within said passageway.

16. The combination of claim 15 wherein a vortex phase separator is also located within said passageway between said gas/liquid discharge and said adjustable valve means.

17. The combination of claim 12, wherein said storage matrix has a plurality of radially extending passageways therein communicating with said central passageway adjacent to said bottom wall.

18. The method of claim 1 also comprising the steps of selecting and locating a porous high thermal conductivity material in heat conducting relation with and between said temperature sensing means and said liquid adsorbent material to improve heat transfer and provide a path for passage of said discharge portion therebetween.

19. The method of claim 18, comprising the step of interspersing layers of said porous high thermal conductivity material within said adsorbent material to improve fluid flow of said discharge through and liquid retention within said adsorbent material.

* * * * *